US008353568B2

(12) United States Patent
Lee

(10) Patent No.: US 8,353,568 B2
(45) Date of Patent: Jan. 15, 2013

(54) INKJET HEAD DRIVING APPARATUS WITH MULTI PULSE GENERATOR

(75) Inventor: Hyun Seok Lee, Seoul (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 140 days.

(21) Appl. No.: 12/923,223

(22) Filed: Sep. 9, 2010

(65) Prior Publication Data

US 2011/0298851 A1 Dec. 8, 2011

(30) Foreign Application Priority Data

Jun. 4, 2010 (KR) ..... 10-2010-0052791

(51) Int. Cl.
*B41J 29/38* (2006.01)

(52) U.S. Cl. ..... 347/11; 347/5; 347/9

(58) Field of Classification Search ..... 347/5, 9–11, 347/68, 70, 71
See application file for complete search history.

(56) References Cited

U.S. PATENT DOCUMENTS 6,450,615 B2 * 9/2002 Kojima et al. ..... 347/46

FOREIGN PATENT DOCUMENTS

| | | | |
|---|---|---|---|
| JP | 9-11457 | | 1/1997 |
| JP | 9-64702 | | 3/1997 |
| JP | 410230596 A | * | 9/1998 |
| JP | 2001-146011 | | 5/2001 |
| JP | 2007-44878 | | 2/2007 |
| KR | 10-2005-0042949 | | 5/2005 |

OTHER PUBLICATIONS

Japanese Office Action for Application No. 2010-208885 issued Sep. 18, 2012.

* cited by examiner

*Primary Examiner* — Juanita D Jackson

(57) ABSTRACT

Disclosed herein is an inkjet head driving apparatus. The inkjet head driving apparatus includes a multi pulse generator that receives a trigger signal, and converts and outputs the trigger signal into a multi pulse signal; an amplifier that amplifies the multi pulse signal output from the multi pulse generator; and a controller that controls the number of pulses of the multi pulse signal generated from the multi pulse generator.

4 Claims, 2 Drawing Sheets

INKJET HEAD DRIVING APPARATUS WITH MULTI PULSE GENERATOR

CROSS REFERENCE TO RELATED APPLICATION

This application claims the benefit of Korean Patent Application No. 10-2010-0052791, filed on Jun. 4, 2010, entitled "Inkjet Head Driving Apparatus", which is hereby incorporated by reference in its entirety into this application.

BACKGROUND OF THE INVENTION

1. Technical Field

The present invention relates to a technology for driving a head of an inkjet printer.

2. Description of the Related Art

Recently, various kinds of printing methods using an inkjet printing method is applied have been introduced. A direct printing type using an inkjet printing method forms a pattern by printing, which does not require a masking process, thereby simplifying the process and reducing the manufacturing costs thereof.

In such an inkjet printing method, a piezo-electric type inkjet head is generally used to print ink to be applied to various kinds of applications. An inkjet head is applied with a driving signal from a head driver to drive an actuator in the head, thereby printing ink. Therefore, a basic head driving operation is determined according to the waveform characteristics of the driving signal of the head driver. Generally, the driving signal is applied to the actuator in a pulse type.

In the inkjet printing method, volume of an ink droplet discharged from the head is generally affected by the level and width of the driving pulse. However, no matter how high the voltage of the driving pulse is increased, sufficient ink discharge amount may not be secured. Therefore, there is a demand for research on driving an actuator using a multi pulse rather than a single pulse.

SUMMARY OF THE INVENTION

An object of the present invention is to provide an inkjet head driving circuit that can effectively output a multi pulse so as to drive an inkjet head.

According to an exemplary embodiment of the present invention, there is provided an inkjet head driving apparatus including: a multi pulse generator that receives a trigger signal, and converts and outputs the trigger signal into a multi pulse signal; an amplifier that amplifies the multi pulse signal output from the multi pulse generator; and a controller that controls the number of pulses of the multi pulse signal generated from the multi pulse generator.

In this case, the trigger signal may be configured of a single pulse signal.

The multi pulse generator may include a plurality of delays that receive the trigger signal to output pulses each having different delay times; and a multiplexer that couples each of the pulses output from the plurality of delays to generate a multi pulse signal.

In addition, the plurality of delays may be connected to each other in series, and each delay may generate a pulse delayed by a predetermined time by receiving an output pulse of a previous delay and supply the generated delayed pulse to a next delay and the multiplexer.

In this case, the controller may control the number of multi pulse signals by connecting or disconnecting each of the pulses output from each of the delays to be supplied to the multiplexer.

DESCRIPTION OF THE PREFERRED EMBODIMENTS

Hereinafter, exemplary embodiments of the present invention will be described with reference to the accompanying drawings. However, the exemplary embodiments are described by way of examples only and the present invention is not limited thereto.

In describing the present invention, a detailed description of well-known technology relating to the present invention may unnecessarily make unclear the spirit of the present invention, the detailed description thereof will be omitted. Further, the following terminologies are defined in consideration of the functions in the present invention and may be construed in different ways by the intention of users and operators. Therefore, the definitions thereof should be construed based on the contents throughout the specification.

As a result, the spirit of the present invention is determined by the claims and the following exemplary embodiments may be provided to efficiently describe the spirit of the present invention to those skilled in the art.

Figure 1:
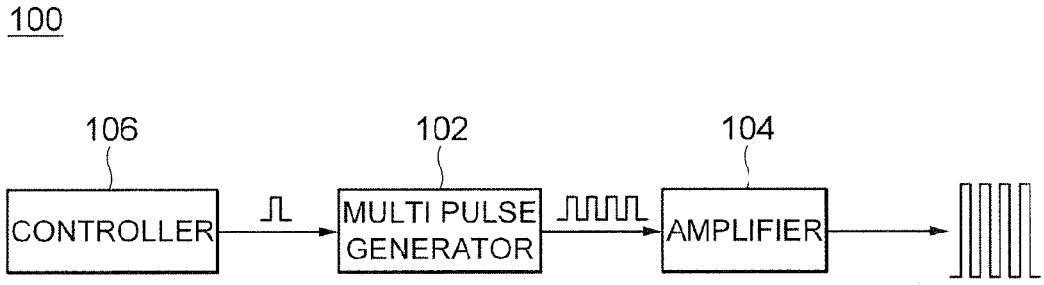
FIG. 1 is a block diagram showing a configuration of an inkjet head driving apparatus 100 according to an embodiment of the present, invention.

FIG. 1 is a block diagram showing a configuration of an inkjet head driving apparatus 100 according to an embodiment of the present invention.

As shown in the figure, the inkjet head driving apparatus 100 according to an embodiment of the present invention is configured to include a multi pulse generator 102, an amplifier 104, and a controller 106.

The multi pulse generator 102 receives trigger signals in a single pulse signal type and converts the trigger signals into multi pulse signals. The multi pulse signal is a signal that a plurality of pulses delaying each of the trigger signals by different delay times are coupled. A detailed configuration of the multi pulse generator 102 will be described with reference to FIGS. 2 to 4.

The amplifier 104 amplifies and outputs the multi pulse signal output from the multi pulse generator 102. The multi pulse signal generated and output from the multi pulse generator 102 is a digital pulse signal having a voltage of about 3-5V. The digital pulse is amplified into a pulse signal having a level of several tens of V for driving an inkjet head by passing through the amplifier 104. The multi pulse signal amplified from the amplifier 104 is applied to a piezo electric actuator as the driving signal of the inkjet head, and the piezo electric actuator discharges a droplet according to the applied driving signal. The amplifier 104 may be configured of, for example, a high voltage switching module, but circuits having any type capable of amplifying the multi pulse signal into a voltage level required by the piezo electric actuator may also be used as the amplifier 104.

The controller 106 supplies the trigger signal to the multi pulse generator 102 and controls the pulse number of the multi pulse signal generated from the multi pulse generator 102. The amount of droplets discharged from the piezo electric actuator is in proportion to the number of pulses of the multi pulse signal generated from the multi pulse generator 102, and the controller 106 controls the number of pulses included in the multi pulse signal generated from the multi pulse generator 102, thereby making it possible to control the amount of droplets.

Figure 2:
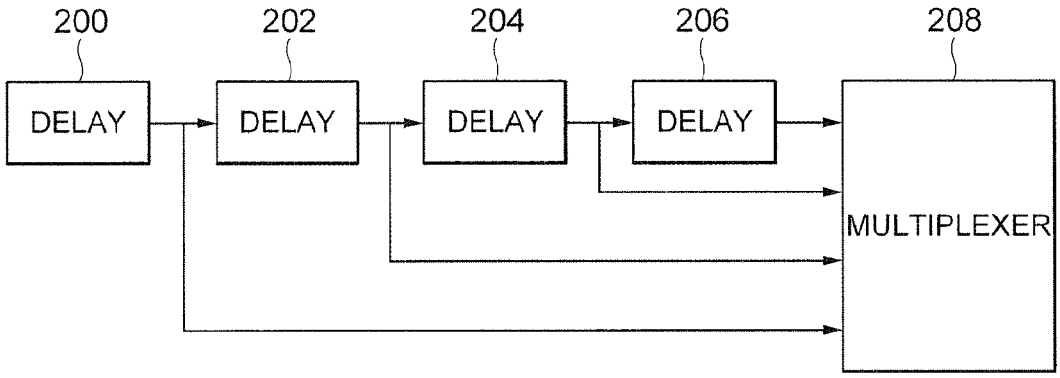
FIG. 2 is a block diagram showing a detailed configuration of the multi pulse generator 102 of the inkjet head driving apparatus 100 according to an embodiment of the present invention.

FIG. 2 is a block diagram showing a detailed configuration of the multi pulse generator 102 of the inkjet head driving apparatus 100 according to an embodiment of the present invention.

As shown in the figure, the multi pulse generator 102 according to an embodiment of the present invention includes a plurality of delays 200, 202, 204, and 206, and a multiplexer 208. Even though the multi pulse generator 102 is shown to include four delays 200, 202, 204, and 206 in the embodiment, the number of delays may be added or subtracted according to the characteristics of the inkjet head or the droplet, and the scope of the present invention is not limited to the specified number of delays.

The plurality of delays 200, 202, 204, and 206 receive the trigger signal from the controller 106 to output pulses each having different delay times. As shown in the figure, the delays 200, 202, 204, and 206 are connected to each other in series in the embodiment of the present invention, wherein each delay is configured to generate a pulse delayed by a predetermined time by receiving an output pulse of a previous delay and to supply the generated delay pulse to a next delay and the multiplexer 208. In the embodiment, it can be appreciated that an output of the delay 200 is applied to the delay 202 and the multiplexer 208, an output of the delay 202 is applied to the delay 204 and the multiplexer 208, and an output of the delay 204 is applied to the delay 206 and the multiplexer 208, respectively. Each of the delays 200, 202, 204, and 206 may be configured to control a delay time, voltage of an output pulse, and the like, by controlling an internal parameter.

The multiplexer 208 are coupled to each pulse output from the plurality of delays 200, 202, 204, and 206 to generate the multi pulse signal. In other words, the output signal from the multiplexer 208 is a signal that output signals from the plurality of delays 200, 202, 204, and 206 are coupled into one. In this case, the controller 106 may control the number of multi pulse signals by connecting or disconnecting each pulse output from each of the delays 200, 202, 204, 206 to be supplied to the multiplexer 208. For example, when the controller 106 applies the pulses output from the delay 200 and the delay 202 to the multiplexer 208 and disconnects the pulses output from the delay 204 and the delay 206, the multi pulse signal has two pulses, and when the controller 106 applies the pulses output from all the delays 200, 202, 204, and 206 to the multiplexer 208, the multi pulse signal has four pulses. The controller 106 may control the number of pulse signals by, for example, having switching devices between an input terminal of the multiplexer 208 and output terminals of each of the delays 200, 202, 204, and 206. Alternatively, when the input signals can be selectively connected or disconnected according to the type of multiplexer 208, the controller 106 may directly control the multiplexer 208.

Figure 3:
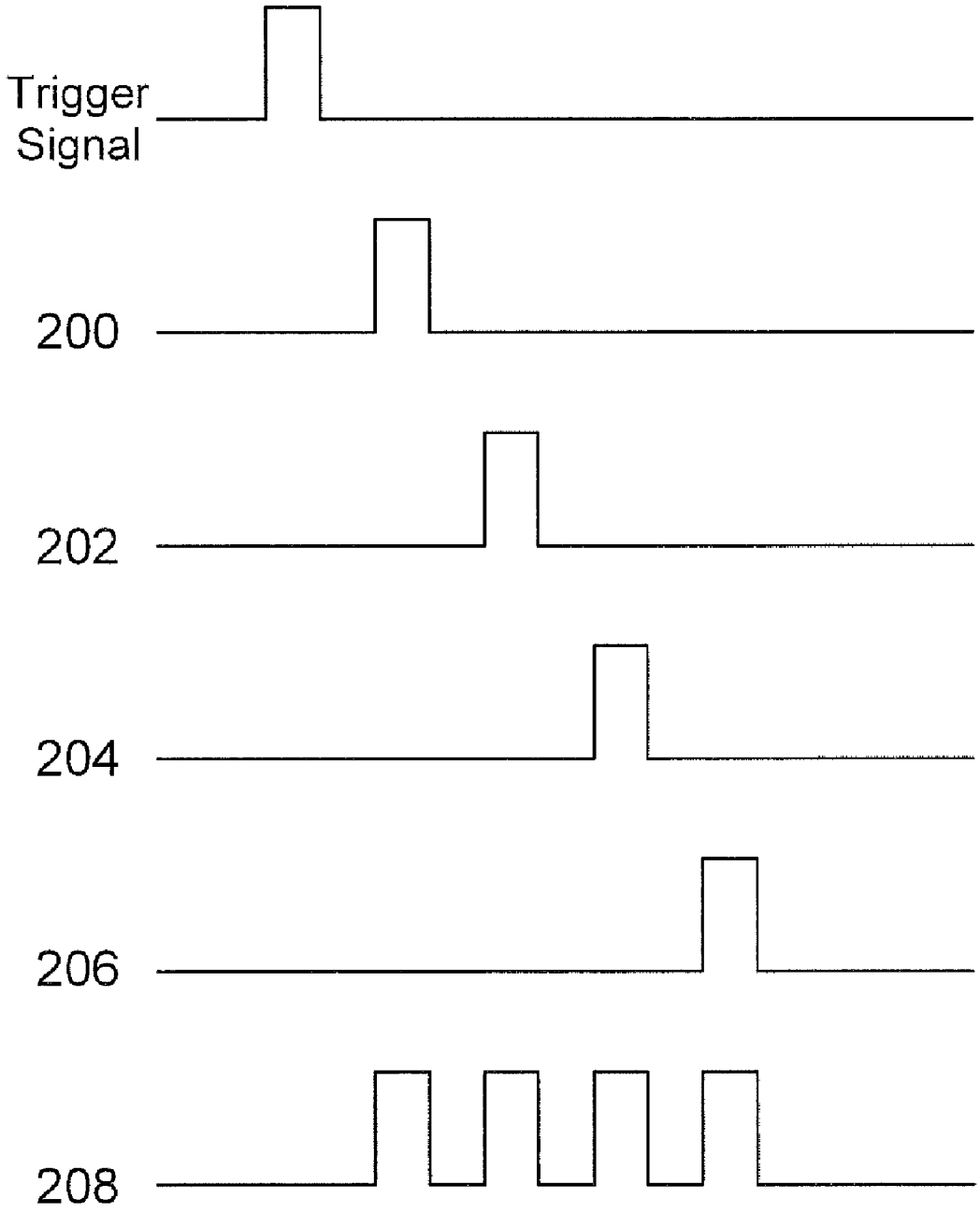
FIG. 3 is a graph for explaining signals generated from each block of the multi pulse generator 102.

FIG. 3 is a graph for explaining signals generated from each block of the multi pulse generator 102.

As shown in the figure, when the trigger signal is applied to the delay 200, the delay 200 outputs a pulse in which the trigger signal is delayed by a predetermined time, and the delay 202 receives the output from the delay 200 to output a pulse in which the output is delayed again by a predetermined time. This same process is performed in the delay 204 and the delay 206. Finally, the multiplexer 208 couples each of the pulses output from the delay 200 to the delay 206 to output a single multi pulse.

According to the present invention, a high voltage multi pulse signal is applied to the ink head, thereby making it possible to output a large amount of ink that has not been able to be implemented with a single pulse.

In addition, the inkjet head driving circuit therefor is configured in a digital scheme, thereby making it possible to generate the desired number and level of multi pulses in a short time even when an ink discharge frequency is increased as compared to the analog scheme according to the prior art.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

Accordingly, the scope of the present invention is not construed as being limited to the described embodiments but is defined by the appended claims as well as equivalents thereto.

What is claimed is:

1. An inkjet head driving apparatus, comprising:

a multi pulse generator that receives a trigger signal, and converts and outputs the trigger signal into a multi pulse signal;

an amplifier that amplifies the multi pulse signal output from the multi pulse generator; and a controller that controls the number of pulses of the multi pulse signal generated from the multi pulse generator, the multi pulse generator including a plurality of delays that receive the trigger signal to output pulses each having different delay times, and a multiplexer that couples each of the pulses output from the plurality of delays to generate a multi pulse signal.

2. The inkjet head driving apparatus according to claim 1, wherein the plurality of delays are connected to each other in series, and each delay generates a pulse delayed by a predetermined time by receiving an output pulse of a previous delay and supplies the generated delayed pulse to a next delay and the multiplexer.

3. The inkjet head driving apparatus according to claim 1, wherein the controller controls the number of multi pulse signals by connecting or disconnecting each of the pulses output from each of the delays to be supplied to the multiplexer.

4. The inkjet head driving apparatus according to claim 1, wherein the trigger signal is configured of a single pulse signal.

* * * * *